United States Patent [19]

Chilpan et al.

[11] 4,164,840

[45] Aug. 21, 1979

[54] METHOD AND APPARATUS FOR TWISTING YARNS

[75] Inventors: Kurt C. Chilpan, Seneca, S.C.; William L. Lewis, Sanford, N.C.

[73] Assignee: Roberts Company, Sanford, N.C.

[21] Appl. No.: 648,771

[22] Filed: Jan. 14, 1976

Related U.S. Application Data

[63] Continuation of Ser. No. 490,580, Jul. 22, 1974, abandoned, which is a continuation-in-part of Ser. No. 326,006, Jan. 23, 1973, abandoned.

[51] Int. Cl.[2] ..... D01H 7/90; D01H 1/10; D01H 7/86

[52] U.S. Cl. ..... 57/313; 57/58.52; 57/59; 57/64

[58] Field of Search ..... 57/34 R, 34 HS, 58.52, 57/58.54, 58.55, 59, 62–64, 124, 156, 313

[56] References Cited

U.S. PATENT DOCUMENTS

| | | | |
|---|---|---|---|
| 2,142,111 | 1/1939 | Camp | 57/124 X |
| 2,887,840 | 5/1959 | Ridgway | 57/63 X |
| 2,887,841 | 5/1959 | Ridgway | 57/64 X |
| 3,383,850 | 5/1968 | Ratti | 57/34 HS X |
| 3,491,528 | 1/1970 | Whittaker et al. | 57/156 |

*Primary Examiner*—Charles Gorenstein

[57] ABSTRACT

Yarns or filaments from producers packages, having little or no twist therein and mounted upon two-for-one spindle units, are uptwisted, directed to a ply twisting unit where the twisted filaments are plied and downtwisted onto a takeup bobbin of a spindle unit. A selected percentage of the required twist is inserted as the plied, cabled filaments are wound upon the takeup bobbin and the remainder of the required twist inserted as the filaments are unwound from the takeup bobbin and directed to a winder unit. Alternatively, the rate of twist applied to the plied filaments may be increased by driving the traveler ring, thus increasing the life or the speed of the traveler which directs plied filaments to the driven takeup bobbin. Occasionally, when two-for-one spindle units are applying extremely high twist, which slows down the delivery of twisted plied filaments, the driven downtwist takeup spindle unit may employ a super high speed stationary traveler ring. Plied filaments extending between the takeup bobbin and the winder unit may be heat set, if desired.

8 Claims, 10 Drawing Figures

METHOD AND APPARATUS FOR TWISTING YARNS

This is a continuation of application Ser. No. 490,580, filed on July 22, 1974 now abandoned, which is a continuation-in-part application of application Ser. No. 326,006 filed Jan. 23, 1973 abandoned.

BRIEF SUMMARY AND OBJECTS OF THE INVENTION

The present invention, a combination of known basic textile principles, relates generally to the twisting, plying and cabling of yarns, and more particularly to a method and apparatus wherein yarn from supply packages may be twisted, plied and cabled on a single machine at speeds which approximately double the production of conventional machines, offering in addition substantial savings in labor, power consumption and floor space.

The plied cabled yarns produced may be especially suitable for textured yarns, tire cords, sewing threads, carpet yarns, fish nets, or other products requiring plied, cabled yarns or cords. The continuous uptwisting and downtwisting operations on the same machine produces exceptional twist uniformity and yarn strength. Elasticity and elastic recovery have proven superior to plied, cable yarns from other production systems. In the present invention, the twist does not set in the individual yarns as it does in the processing delay encountered in two-step ply and cable operations. Rayon yarns, in particular, are especially susceptible to this setting. The plied thermoplastic yarns may be permanently heat set, if required, on the same machine in one operation.

A plurality of yarns, which may have very little twist therein, are withdrawn from packages mounted upon two-for-one spindle units and directed upwardly by various guides to a roll unit. The plurality of yarns are plied and cabled as they emerge from the roll unit and are directed downwardly to a cabling unit which includes a stationary or rotating ring, traveler and driven takeup bobbin.

Limiting factors in the production of plied and cabled yarns on conventional machines are the rotational speed of the takeup bobbin spindle and the traveler life. As a result of this inefficiency of the takeup bobbin spindle, due to limitations on traveler speed, which governs traveler life, the two-for-one spindle units rotate at a speed less than they are capable of rotating.

In the present invention, a selected portion of the required twist is inserted in the plied yarns as they are wound upon the takeup bobbin. When the bobbin is full, the plied yarn is cut and the end directed through suitable guides and tensioning devices to a takeup or winder unit. The remainder of the required twist is inserted in the plied yarns as they are unwound from the rotating bobbin and directed to the winder unit.

In another embodiment of the invention, after a selected portion of the required twist has been inserted during downtwisting as the plied yarns are wound upon a takeup bobbin by ring and traveler means, the full bobbin is relocated upon a travelerless, adjacent spindle and the remainder of the required twist is applied to the yarn as it is withdrawn from the full bobbin and directed to a winder unit.

Alternatively, rather than unwinding the partially twisted cable from the takeup bobbin and directing it while rotating to a winder unit, the linear speed of the traveler, thus the production of the machine, can be substantially increased by driving the twister ring with traveler on it in the same direction as the takeup bobbin.

To simplify a piece of machinery and to make it more competitive in price, when it is used for production of speciality twines requiring two-for-one spindle applications to run with extremely high initial twist which slows down the delivery of twisted plied yarns or filaments moving from a two-for-one spindle to a single downtwist unit, thus permitting the spindle to run with less revolutions per minute which in turn slows down the speed of the traveler, it may be advisable for reasons of profitability to equip the takeup bobbin with stationary super high speed traveler ring.

One of the primary objects of the invention is the provision of a new and improved system for twisting, plying, cabling, and, if desirable, heat setting of yarns on the same machine.

Another object of the invention is the provision of a new and improved yarn twisting and plying system resulting in a high production rate with exceptional twist uniformity and yarn strength.

A further object of the invention is the provision of a yarn twisting, plying and cabling system which reduces yarn handling and which results in yarns having better elasticity and greater elastic recovery than yarn produced by two or more processes.

Other objects and advantages of the invention will become apparent when considered in view of the following detailed description.

DETAILED DESCRIPTION OF THE INVENTION

Figure 1:
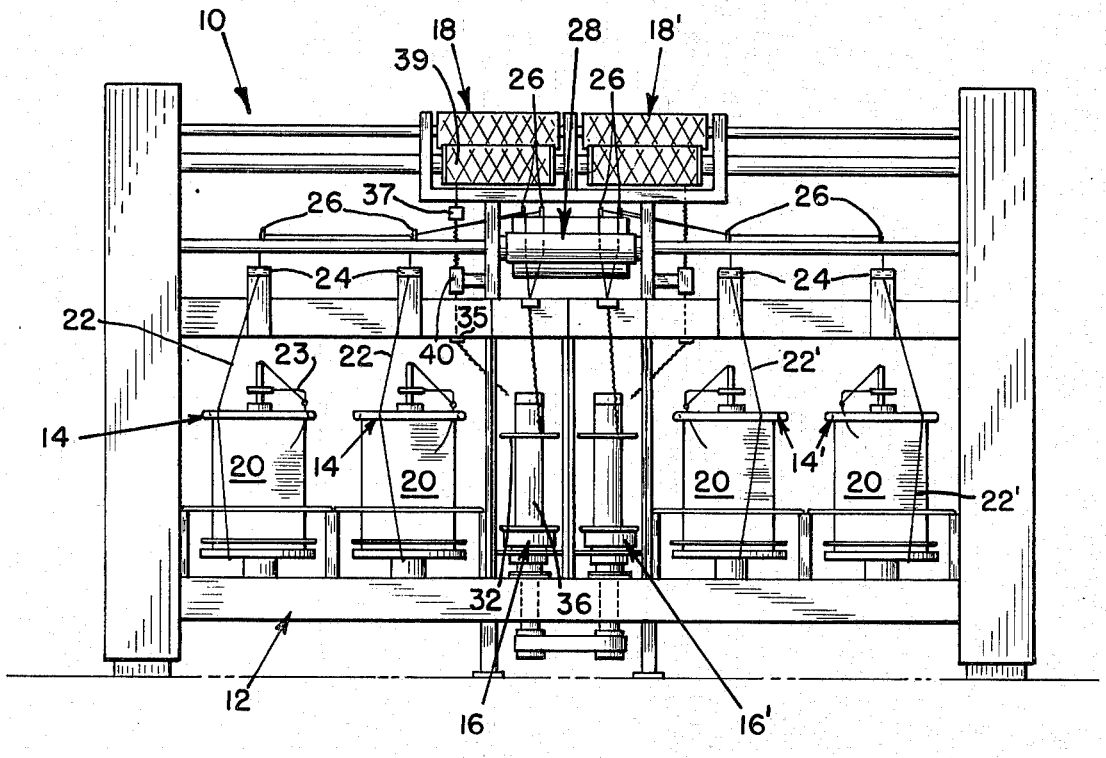
FIG. 1 is a schematic, side elevational view of one embodiment of the present invention illustrating yarns being directed from two-for-one spindles to selected takeup bobbins and from previously filled takeup bobbins through heat setting and cooling zones to a winder unit.
Figure 2:
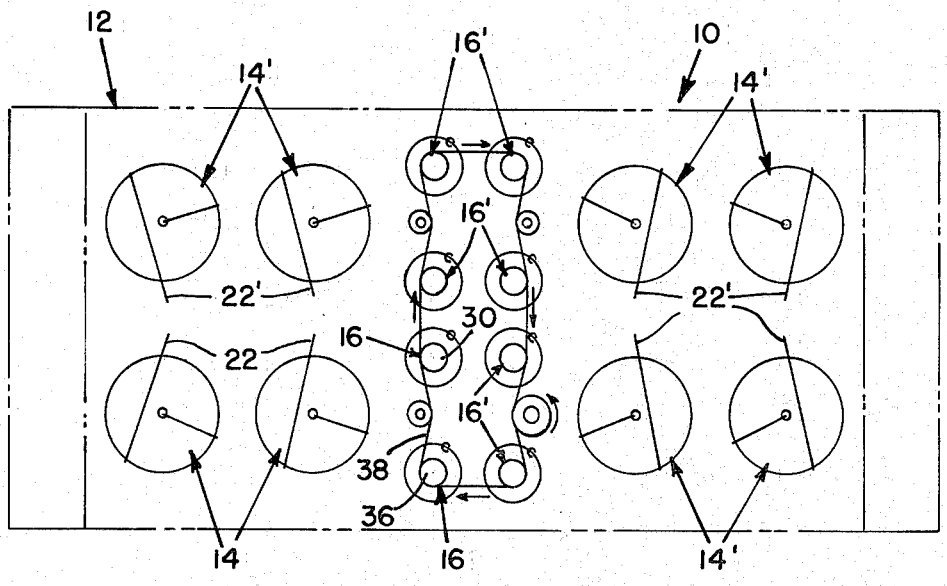
FIG. 2 is a schematic top plan view of the machine of FIG. 1 with parts removed to illustrate the two-for-one spindle and takeup bobbins on each side of the machine.
Figure 3:
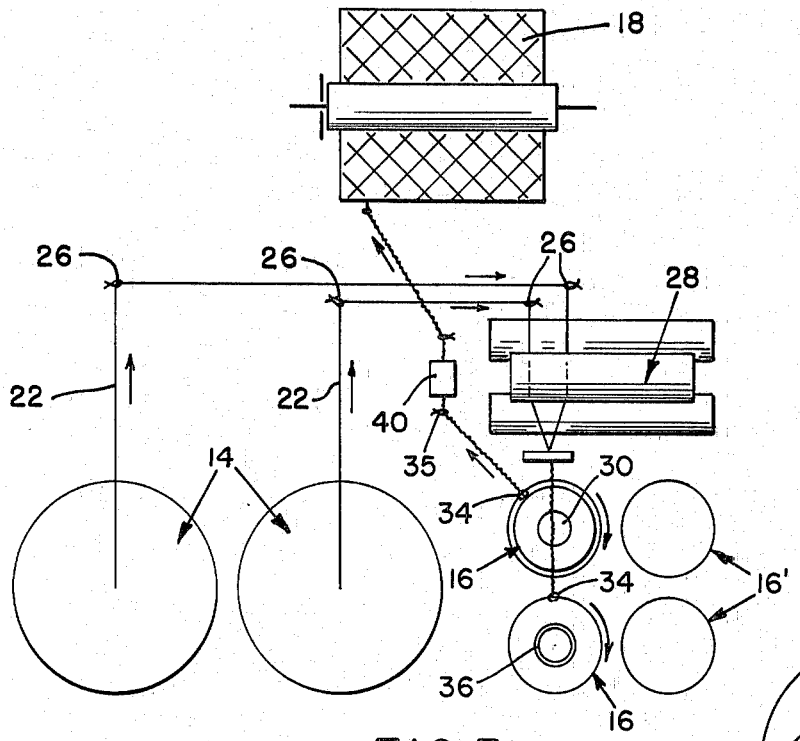
FIG. 3 is an enlarged, schematic, top plan view of one unit of the machine illustrating the yarn travel from the two-for-one spindles to the takeup bobbins and from the takeup bobbins to the yarn heating devices and winder units.

Referring to the drawing and particularly FIGS. 1-3, the twisting apparatus 10 includes a frame 12 supporting a plurality of two-for-one uptwist spindle arrangements 14 and 14', a plurality of down twist spindle units 16 and 16' and a plurality of winder assemblies 18 and 18'.

Each two-for-one uptwist spindle 14 and 14' is of a conventional type supported upon the frame 12. Each spindle arrangement 14 and 14' supports a yarn package 20, which may be a producers package having yarn 22 or 22' with little or no twist therein. Each package 20 remains essentially stationary and a conventional yarn take-off flyer 23 rotates to remove yarn from the package, directs it axially downwardly through the spindle arrangement 14 and upwardly around the package, as shown by FIG. 1. Thus twist is applied to the yarn 22 as it is directed from the package outer periphery downwardly through the spindle and a second twist is applied as the yarn moves from the spindle and upwardly around the package to the guides 24 and 26.

The guides 26 direct the yarns 22 in separate paths to a roll unit 28 where the two yarns 22 are directed to the roll unit 28 in spaced, parallel relation. The yarns are directed from the roll unit 28 through a suitable guide to a spindle unit 16 which includes a bobbin 30, a traversing ring rail with traveler ring 32 and a traveler 34. Upon emerging from the roll unit 28, the two yarns 22 are plied together, as shown by FIGS. 1 and 3, due to the twist imparted thereto by the driven spindle bobbin 30. However, in order to have high production, and get acceptable traveler life, approximately only one-half of the required twist is applied to the plied yarns as they are wound upon the bobbin 30.

When the bobbin 30 is full, the machine is stopped and plied yarns 22 are severed above the bobbin 30. The plied, cabled ends then are taken off the full bobbin 30, directed through a guide 35 and a yarn guide tensioning device 37 and attached to a takeup spool or tube 39 of the winder assembly 18.

Next, the severed yarn ends 22 extending from the roll unit 28 are attached in a conventional manner to the empty bobbin 36 of the other spindle unit 16. Now the machine is started, with the yarn 22 from the two-for-one spindle units 14 emerging from the roll unit 28 and being wound upon the bobbin 36 and with the plied yarns being withdrawn from the full bobbin 30 and wound upon the tube or spool 39 of winder unit 18.

It is to be noted that the bobbins 30 and 36 rotate in the same direction and at the same speed at all times. The spindle unit 16 may be driven by a tape, belt 38 or other means, FIG. 2. Since the bobbins 30 and 36 rotate in the same direction and at the same speed, the required second half of the required twist is inserted in the plied yarns as they are withdrawn from the driven bobbin 30 and wound upon the takeup spool or tube 39.

When the plied yarns are unwound from bobbin 30 and the bobbin 36 is full, the machine is stopped and the process is switched. Now, plied yarns from the full bobbin 36 are severed and the ends from the bobbin attached to the winder assembly 18. The severed yarn ends emerging from the roll unit 28 are attached to the empty bobbin 30 and the machine is restarted.

If the plied and cabled yarns have heat setting requirements, a conventional yarn heat setting unit 40 may be provided to treat the plied yarns. The heat setting unit 40 may be positioned in the yarn path prior to the tensioning device 37 such that the plied yarns are treated as they are unwound from bobbin 30 or 36 and directed to a can or to the winder assembly 18.

In the embodiment of the invention illustrated by FIGS. 1-3, the linear yarn delivery upwardly is substantially equal to the yarn delivery downwardly. However, twist insertion per unit of yarn length, or per unit of time, may greatly differ. Uptwisting with a traveler has a speed limitation common to any ring and traveler method.

Since the downtwisting is by means of a ring and traveler, twist insertion is limited to the maximum speed permitted or governed by the acceptable traveler life. On the other hand, uptwisting without a traveler eliminates speed restrictions due to traveler wear and excessive yarn tension, and primarily is limited only by power consumption. Therefore, if the uptwist spindle is driven faster than the downtwist bobbin and spindle, more twist will be inserted during the uptwisting operation.

Figure 8:
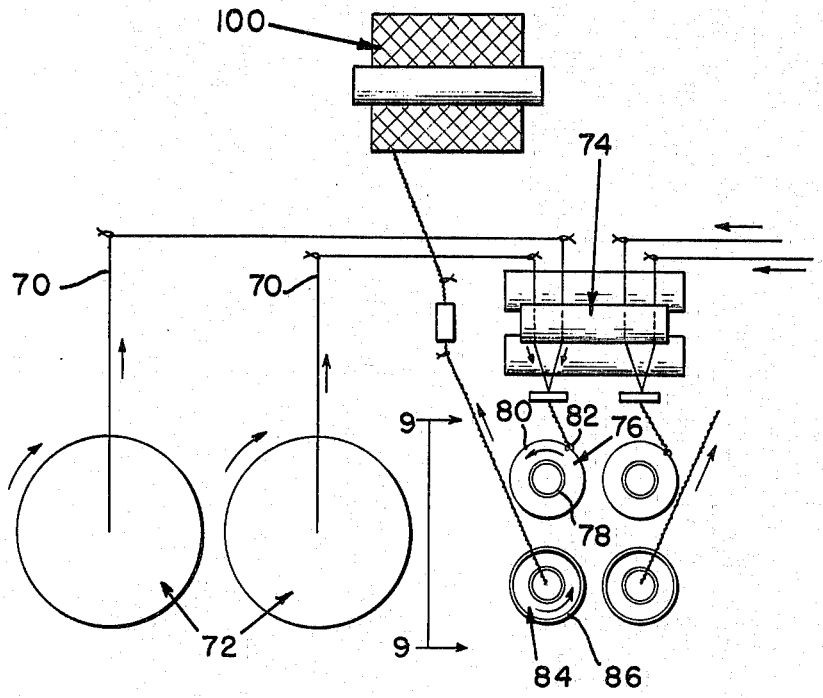
FIG. 8 is an enlarged, schematic, top plan view of a modified unit of the machine illustrating yarn travel from the two-for-one spindle units to the takeup bobbin position equipped with a ring and traveler, and a travelerless spindle unit for receiving a full bobbin and provided with a pot to prevent damage to the yarn as it is withdrawn from the full bobbin.
Figure 9:
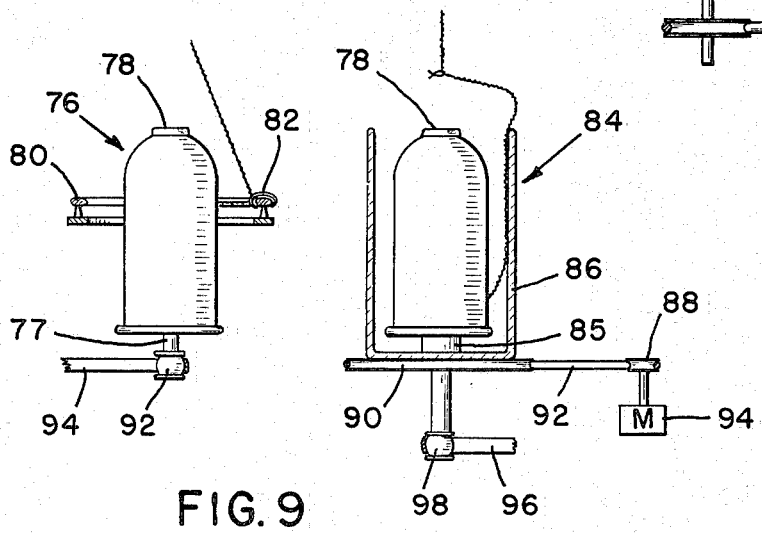
FIG. 9 is an enlarged, side elevational view of adjacent spindle units looking in the direction of arrows 9—9 of FIG. 8, and including a downtwist spindle unit equipped with a ring and traveler, and a travelerless, uptwist spindle unit provided with a pot.

FIGS. 8 and 9 relate to a modified embodiment of the invention wherein a portion of the desired twist is inserted in the yarn while downtwisting by means of a ring and traveler, and the remaining desired twist is applied by uptwisting the yarn without a traveler. For example, 40% of the twist could be inserted by the ring and traveler spindle unit while downtwisting, and 60% of the twist inserted by a balloon carrying pot spindle unit during uptwisting.

FIG. 8 is somewhat similar to FIG. 3 with the yarns 70, 70 being withdrawn from two-for-one spindle units 72, 72, directed by various guides to a roll unit 74 for controlling delivery speed, and to a spindle unit 76 which includes a driven spindle 77 having a bobbin 78 thereon, a traversing ring rail with a ring 80 and a traveler 82. An adjacent travelerless spindle unit 84 is provided for receiving a full bobbin 78. The full bobbin is mounted upon a rotatable spindle 85 and surrounded by a pot 86 which prevents damage to the yarn. The balloon carrying pot 86 may be driven at a selected speed from a motor 94 by means of the pulleys 88, 90 and belt 92. The pot may be driven to rotate at the same speed as the unwinding yarn, slower than the unwinding yarn or faster than the speed of the unwinding yarn, as desired.

The spindle 77 of spindle unit 76 may be provided with whorl 92 which frictionally engages a drive belt 94, while spindle 85 may be driven by a friction belt 96 engaging whorl 98.

Alternatively, the spindles 77 and 85 may be driven from a common belt with the diameters of whorls 92, 98 being of different, selected sizes to vary the spindle speeds.

In operation of the embodiment of FIGS. 8 and 9, spindle unit 76 operates as a ring and traveler downtwister filling the bobbin 78 with yarn. Simultaneously, spindle unit 84 operates as a travelerless uptwister with yarn being drawn from a full bobbin 78 and directed to the winder unit 100. As the yarn is initially twisted and the bobbin on unit 78 becomes full, and all yarn has been withdrawn from the bobbin on unit 84, the fully wound bobbin is removed from the spindle of the ring and traveler unit 76 and placed upon the spindle of the neighboring travelerless unit 84 for receiving the final twist during uptwisting. An empty bobbin is placed upon spindle unit 76 for receiving yarn. The bobbins are moved from one unit to another each time one bobbin is fully wound and yarn is completely withdrawn from the other bobbin. Production is increased even greater by this method since, for example, 40% of the required twist is inserted during downtwisting where the twist is limited by the speed and acceptable life of the traveler, and by rotating the uptwist bobbin at a higher r.p.m., where the speed is not limited by a traveler, the remaining 60% of the twist is inserted. The yarn delivery speed to the ring and traveler spindle unit 76 and the takeup speed of the winder 100 would be the same. Elimination of the traveler during uptwisting also serves to reduce oil damage to the yarn and eliminates costly traveler changes.

Preferably, not less than 35% of the desired twist is applied by the ring and traveler spindle unit during downtwisting, and not more than 65% of the desired twist is inserted during free uptwisting of the yarn as it is directed to the winder 100. However, the ratio of twist percentages will vary and depends upon the type of machine, type of fibers being processed, power consumption, speed limitations of travelers, etc.

Figure 10:
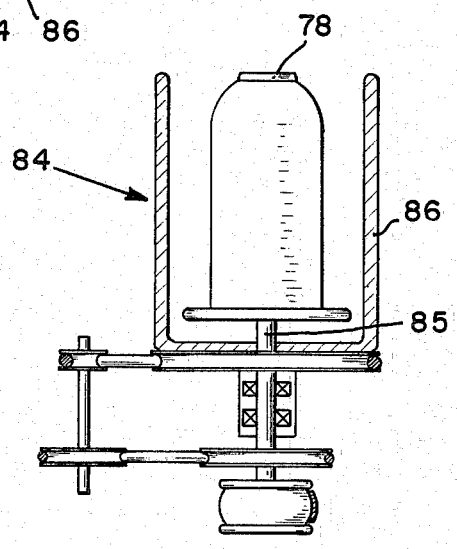
FIG. 10 is a side elevational view of an uptwist spindle unit illustrating a modified arrangement for driving the spindle and pot.

FIG. 10 illustrates an alternate means for driving the spindle and pot of an uptwisting spindle unit 84 from a common drive source. The relative speeds of the spindle and pot may be selected by varying the sizes of the pulleys.

Figure 5:
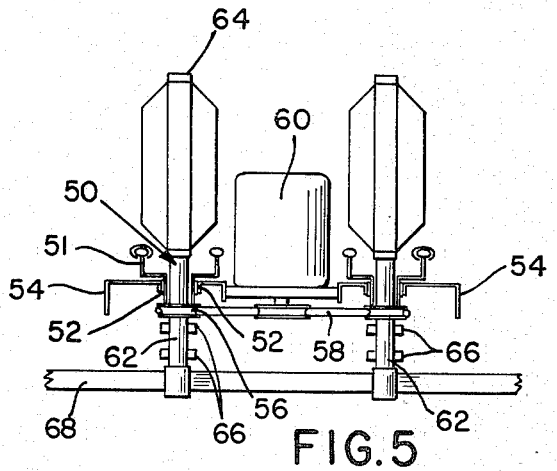
FIG. 5 is a schematic, enlarged, end elevational view of the drive for the modified takeup bobbin arrangement of FIG. 4.
Figure 4:
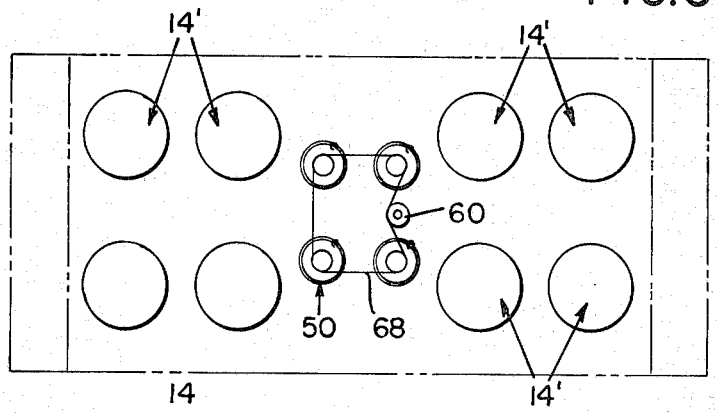
FIG. 4 is a schematic, fragmentary, top plan view of the machine illustrating one embodiment of a modified takeup bobbin arrangement.
Figure 6:
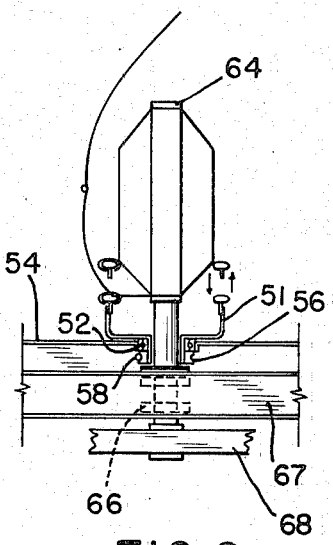
FIG. 6 is a schematic, fragmentary, front elevational view of one spindle unit of the embodiment of FIGS. 4 and 5.

FIGS. 4–6 relate to a modified embodiment of the invention wherein the machine production is greatly increased by positively driving the ring 51 of a spindle unit 50. Two yarns are withdrawn from the two-for-one spindle arrangements 14, and directed by guides to a roll unit, similar to the embodiment of FIGS. 1–3, wherein the plied yarns are twisted and wound upon the bobbin of spindle unit 50. The spindle unit ring 51 is supported for rotation by one or more bearings 52 which are secured to the ring rail 54. The ring 51 has a pulley 56 secured to the lower end thereof which is driven by belt 58 from a motor 60. The motor 60 may be secured between the ring rails 54 at the two sides of the machine for vertical reciprocation therewith.

Figure 7:
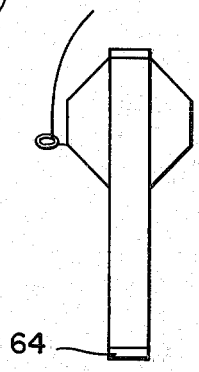
FIG. 7 is a schematic front elevational view of a takeup bobbin illustrating the manner of progressively winding yarns thereon from the top to the bottom.

The spindle unit 50 includes a rotatable shaft or spindle 62 which supports a bobbin 64 adapted to have yarn wound thereon. The spindle 62 is supported for rotation in bearings 66 which may be secured to the spindle rail 67 or other part of the machine frame. The spindle 62 may be frictionally driven by a belt 68 in a conventional manner. The belt 58 or other ring driving means may move with the ring rail. The drive belts 58 and 68 are arranged to rotate the ring 51 and the spindle 62 in the same direction. The yarn may be wound upon the bobbin 64 with a filling wind, as shown by FIG. 7, wherein the yarn may be initially wound upon the upper end of the bobbin and gradually traverses, due to the movement of the ring 51 and ring rail 54, to the lower end of the bobbin wherein the bobbin is full, as shown by FIG. 5. A hinged ring and a drive variation may permit bobbins to be filled from the bottom in a conventional manner.

The roll units 28, spindle units 16, 16', and winder units 18, 18' may be conventionally driven through various gearing, belts, shafts, etc., mounted upon the frame 12.

The various embodiments of the invention may be provided with yarn tensioning means, if required, depending upon the yarn speeds, types of fibers being processed and other twisting conditions.

While the invention has been described for the plying together of two yarns, it is to be understood that more than two yarns may be used.

We claim:

1. A machine for twisting and plying yarns comprising: a support frame, a plurality of two-for-one spindle assemblies mounted upon said support frame, a yarn supply package mounted upon each two-for-one spindle assembly, each two-for-one spindle assembly applying a twist to the yarn drawn therefrom, a plurality of spindle units, eacgh including a driven bobbin mounted upon said support frame, means for directing the individually twisted yarns from said two-for-one spindle assemblies toward a bobbin positioned upon a first spindle unit, said spindle unit plying and downtwisting the yarns onto said bobbin to form a package, a yarn winder assembly mounted upon said support frame, means for directing the yarns from said bobbin, upon completion of the formation of said package, to said yarn winder assembly, said driven bobbin applying additional twist to the yarn being unwound from the full package and being directed to said winder assembly.

2. The machine of claim 1, wherein each of said plurality of spindle units includes a driven bobbin, and the first plurality of individually twisted yarns are directed from said two-for-one spindle assemblies, plied, and twisted on a bobbin of said first spindle unit simultaneously with the twisting of a plurality of plied yarns being withdrawn from a full bobbin mounted upon a second spindle unit of said plurality of spindle units.

3. The machine of claim 2, wherein each of said plurality of spindle units includes a ring and traveler means for directing yarns to and from a bobbin.

4. The machine of claim 2, wherein a first portion of said plurality of spindle units includes ring and traveler means for applying and twisting the yarns being supplied from said two-for-one spindle assemblies, and the remaining second portion of said plurality of spindle units including means for withdrawal of yarn from bobbins positioned thereon.

5. The machine of claim 4, wherein approximately one-half of said plurality of spindle units includes ring and traveler means and the remaining one-half of said plurality of spindle units each includes a pot for preventing damage to the yarn withdrawn from a bobbin positioned thereon during uptwisting of the yarn to said winder assembly.

6. The machine of claim 5, wherein said pot is positively driven at a selected speed relative to the speed of the yarn unwinding from an associated bobbin.

7. The machine of claim 5, wherein said pot rotates at the same speed as the speed of the yarn withdrawn from a bobbin associated with said pot.

8. The machine of claim 1, and further including means mounted upon said support frame for heat-setting and plied yarns subsequent to removal from said bobbin and prior to being received by said yarn winder assembly.

* * * * *